US007007931B2

(12) United States Patent
Tobinai

(10) Patent No.: US 7,007,931 B2
(45) Date of Patent: Mar. 7, 2006

(54) ROTARY THROTTLE VALVE CARBURETOR

(75) Inventor: Teruhiko Tobinai, Miyagi-ken (JP)

(73) Assignee: Walbro Japan, Inc., Tokyo (JP)

( * ) Notice: Subject to any disclaimer, the term of this patent is extended or adjusted under 35 U.S.C. 154(b) by 120 days.

(21) Appl. No.: 10/445,510

(22) Filed: May 27, 2003

(65) Prior Publication Data

US 2004/0017014 A1 Jan. 29, 2004

(30) Foreign Application Priority Data

Jun. 3, 2002 (JP) ..... 2002-161710
Jun. 12, 2002 (JP) ..... 2002-171548
Oct. 23, 2002 (JP) ..... 2002-308510

(51) Int. Cl.
*F02M 9/08* (2006.01)

(52) U.S. Cl. ..... 261/44.6; 261/44.8

(58) Field of Classification Search ..... 261/44.6–44.8, 261/50.1, 64.1, 64.2, 65, 71, DIG. 38, DIG. 84
See application file for complete search history.

(56) References Cited

U.S. PATENT DOCUMENTS

| | | | | |
|---|---|---|---|---|
| 922,145 | A * | 5/1909 | Howarth | 261/51 |
| 2,004,003 | A * | 6/1935 | Kennedy | 261/44.2 |
| 2,017,239 | A * | 10/1935 | Fitz Gerald | 261/44.6 |
| 2,325,010 | A * | 7/1943 | McCurdy | 261/41.4 |
| 2,595,720 | A * | 5/1952 | Snyder | 261/50.2 |
| 4,779,480 | A * | 10/1988 | Stocker | 74/513 |
| 5,078,111 | A * | 1/1992 | McCann | 123/400 |
| 5,215,049 | A * | 6/1993 | Wolf | 123/179.18 |
| 5,236,634 | A | 8/1993 | Hammett et al. | 261/71 |
| 5,667,734 | A | 9/1997 | Ohgane | 261/71 |
| 5,753,148 | A | 5/1998 | King et al. | 261/71 |
| 5,984,281 | A | 11/1999 | Hacker et al. | 261/71 |
| 6,231,033 | B1 | 5/2001 | Araki | 261/44.8 |
| 6,347,787 | B1 | 2/2002 | Tobinai et al. | 261/23.3 |
| 6,349,925 | B1 | 2/2002 | Tobinai et al. | 261/23.3 |
| 6,394,425 | B1 * | 5/2002 | Nagata | 261/44.8 |
| 6,672,570 | B1 * | 1/2004 | Takano et al. | 261/39.2 |

FOREIGN PATENT DOCUMENTS

| | | |
|---|---|---|
| EP | 1063410 | 12/2000 |
| EP | 1138925 | 10/2001 |
| JP | 0169765 | 3/1989 |
| JP | 0080960 | 3/2000 |

* cited by examiner

*Primary Examiner*—Richard L. Chiesa
(74) *Attorney, Agent, or Firm*—Reising, Ethington, Barnes, Kisselle, P.C.

(57) ABSTRACT

A rotary throttle valve carburetor includes an air intake passage and a throttle valve bore formed in a carburetor body, a cam disposed in the throttle valve bore, and a throttle valve disposed in the throttle valve bore so that one end engages the cam and the other end is accessible from outside the throttle valve bore for operable connection to a throttle valve lever. The carburetor may also have a cable holder with a receiving cylinder for an outer tube of a throttle valve lever cable, an insert port for an inner wire of the cable and a slit between the receiving cylinder and insert port. The slit is smaller than an end of the inner wire to prevent that end from passing through the slit. The carburetor may further include a tamper resistant fuel adjustment bolt including an anti-turning body keyed to the carburetor body and splined to the adjustment bolt after calibration of the carburetor to prevent inadvertent rotation, or user tampering with the calibrated setting.

22 Claims, 8 Drawing Sheets

ROTARY THROTTLE VALVE CARBURETOR

REFERENCE TO RELATED APPLICATIONS

Applicant claims priority of Japanese Patent Applications, Ser. No. 2002-161,710 filed Jun. 3, 2002; Ser. No. 2002-171,548 filed Jun. 12, 2002; and Ser. No. 2002-308,510 filed Oct. 23, 2002.

FIELD OF THE INVENTION

The present invention relates generally to a carburetor, and more particularly to a rotary throttle valve carburetor.

BACKGROUND OF THE INVENTION

In the conventional rotary throttle valve carburetor, moving the rotary throttle valve via a link or lever mechanism, an excessive or undesirably high force may be required to operate the throttle, which can be a limiting requirement in design. Further, a cam for causing the rotary throttle valve to move vertically is also provided between the carburetor body and a lever that actuates the rotary throttle valve. This limits the design freedom as far as shape of the cam and the type of mateiral that can be used.

In a fuel adjustment needle valve of a carburetor proposed in Japanese Patent Application No. 2000-045884, a head portion of an adjustment bolt is received in a vacant portion of a carburetor body, a plug or cap is pressed into the vacant portion and then caulked or the like so that the plug may not be removed, and the engine operator may not adjust the adjustment bolt arbitrarily. The above-described fuel adjustment needle valve of a carburetor poses a problem that the plug or cap is difficult to process and assemble.

As shown in FIG. 16, the conventional throttle valve operating mechanism for a rotary throttle carburetor includes a mounting flange 108 of a lid plate, a holding thread 103 cut in an outer peripheral portion at an end of a cable holder 102 provided with a hexagonal nut 101, and an insert port 104 formed on a central portion at an extreme end of the cable holder 102. For mounting a remote control cable, an end of the inner wire is drawn out of the insert port 104, and the end of the inner wire is retained in a groove 106 of a swivel 105 of a throttle valve lever which engages an idle position bolt 109 when the throttle valve is in its idle position. Then play in the cable is adjusted by rotating the nut 101 and its holding thread 103, and further positioning is done by a lock nut 107. However, it is difficult to mount and retain the inner wire in the groove 106 of the swivel 105 since the surrounding space is narrow and crowded, and the split groove 106 is small. Further, since the insert port 104 is larger in diameter than the inner wire, the outer tube can fall off from the cable holder 102 during assembly.

SUMMARY OF THE INVENTION

A rotary throttle valve carburetor includes an air intake passage and a throttle valve bore formed in a carburetor body, a cam disposed in the throttle valve bore, and a throttle valve disposed in the throttle valve bore so that one end engages the cam and the other end is accessible from outside the throttle valve bore for operable connection to a throttle valve lever. The carburetor may also have a cable holder with a receiving cylinder for an outer tube of a throttle valve lever cable, an insert port for an inner wire of the cable and a slot between the receiving cylinder and insert port. The slit is smaller than an end of the inner wire to prevent that end from passing through the slit. The carburetor may further include a tamper resistant fuel adjustment bolt including an anti-turning body keyed to the carburetor body and splined to the adjustment bolt after calibration of the carburetor to prevent inadvertent rotation, or user tampering with the calibrated setting.

In one form, a driven gear formed on the upper end of the throttle valve and a drive gear connected to a shaft on which a valve lever of the throttle valve is mounted are meshed with each other, and the gears are disposed in an encasing chamber sealed by a lid plate to prevent dust or the like from fouling a valve chamber and the rotary throttle valve. An accelerating pump may be provided, and may be driven by a cam on the lower surface of the drive gear is disposed between the rotary throttle valve and the shaft on which the valve lever of the throttle valve is mounted to permit the size of the carburetor to be minimized.

According to another embodiment of a carburetor, a fuel adjustment needle valve is secured in place to prevent tampering or inadvertent rotation of the valve. An antiturning body is held in a holding hole formed on a pump cover plate, and after setting the position of an adjustment bolt, a spline hole formed on the antiturning body is fitted on a spline shaft portion of the adjustment bolt. An antiturning piece formed on the antiturning body is received in a groove in the carburetor body to prevent turning of the antiturning body and the adjustment bolt.

According to another aspect of the invention, a remote control throttle cable holder includes a receiving cylinder for receiving an end of an outer tube of the remote control cable, and an insert port in communication with the receiving cylinder through a slit is provided on the cable holder whereby the end of the inner wire is engaged with the slit when an end of the inner wire is mounted on a swivel of a throttle valve lever. The outside diameter of the slit is smaller than that of the end of the inner wire, therefore the outer tube is held on the cable holder so as not to fall off, and thus the cable is easy to mount to the cable holder.

Some potential objects, features and advantages of the invention include providing a carburetor in which a rotary throttle valve can be rotated smoothly, which is small and compact in size, has high design freedom, provides a fuel adjustment needle valve for a carburetor which prevents user tampering with a calibrated setting, and is of reltaively simple design and economical and easy manufacture and assembly.

BRIEF DESCRIPTION OF THE DRAWINGS

These and other objects, features and advantages of the present invention will be apparent from the following detailed description of the preferred embodiments, appended claims and accompanying drawings in which:

DESCRIPTION OF THE PREFERRED EMBODIMENTS

Figure 1:
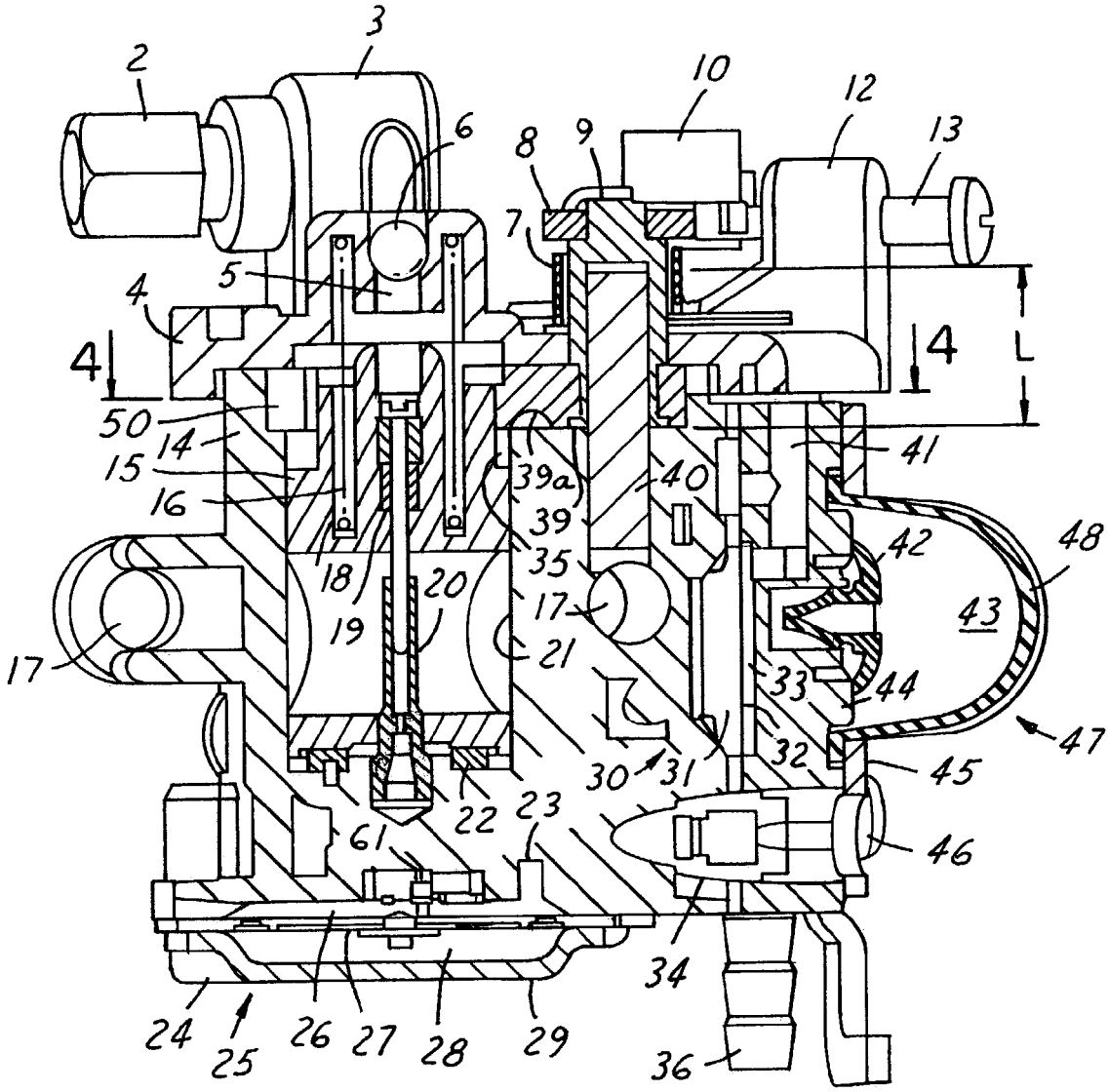
FIG. 1 is a front sectional view of one presently preferred embodiment of a rotary throttle valve carburetor taken generally along line 1—1 of FIG. 4.
Figure 2:
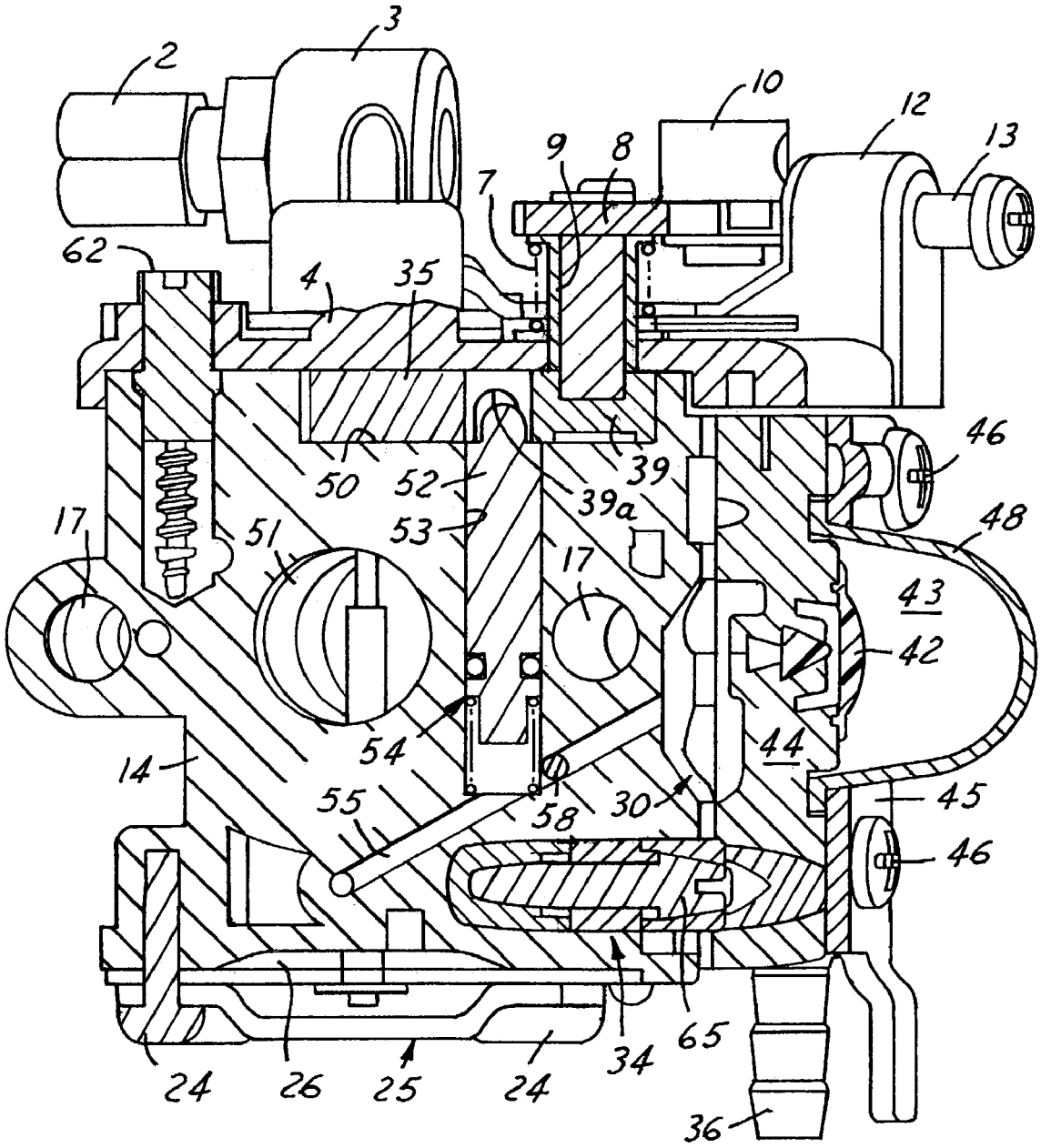
FIG. 2 is a front sectional view of the rotary throttle valve carburetor taken generally along line 2—2 of FIG. 4.

As shown in FIGS. 1 and 2, a carburetor has a carburetor body 14 with an air intake passage 51 extending through the body. In assembly, the carburetor is disposed between an air cleaner, not shown, and a wall surrounding an intake port of the engine, preferably with an insulating plate between them. The body 14 may be fastened to the engine by a pair bolts extending through mounting holes 17. A rotary throttle valve 15 having a throttle hole 18 is rotatably and axially slidably received in a cylindrical valve chamber 21 that is formed perpendicular to the air intake passage 51 of the carburetor body 14.

Figure 7:
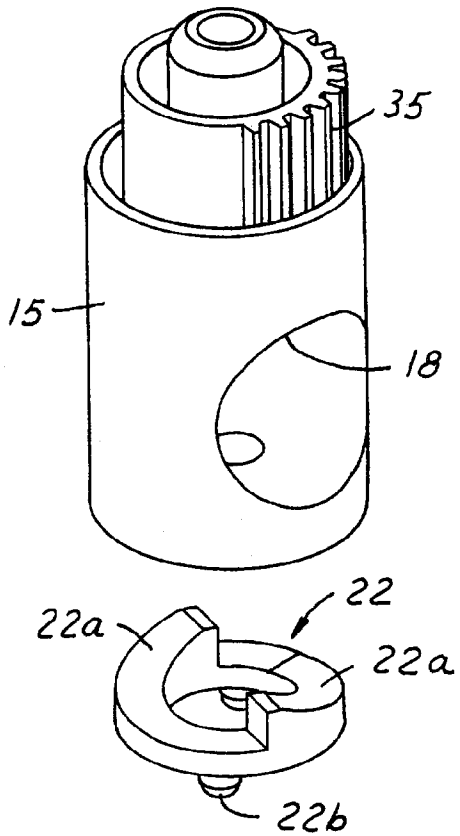
FIG. 7 is another perspective view of the rotary throttle valve and annular cam.
Figure 6:
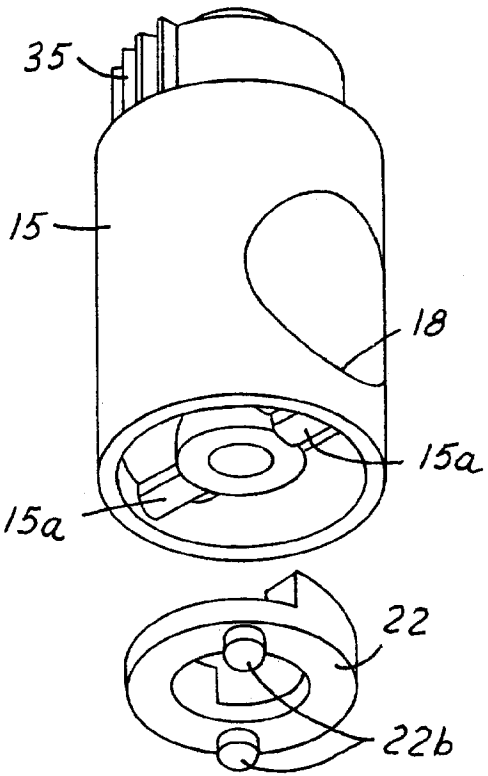
FIG. 6 is a perspective view of a rotary throttle valve and an annular cam.

An annular cam 22 is provided at the bottom of the valve chamber 21 and has a pair of peripheral cam surfaces 22*a* (FIG. 7) with a height that varies along the circumferential extent of the cam surfaces 22*a*, as shown in FIGS. 6 and 7. The cam 22 has a pair of pins 22*b* which are inserted into pin holes in the valve chamber 21. Rod-like followers 15*a* carried by the throttle valve 15 extend radially and are engaged with the cam surfaces 22*a* so that rotation of the throttle valve 15 causes axial movement of the throttle valve 15. However, other arrangements are possible. For example without limitation, the cam surfaces 22*a* may be formed in the bottom surface of the rotary throttle valve 15, and the follower 15*a* may be provided on the bottom of the valve chamber 21.

Figure 3:
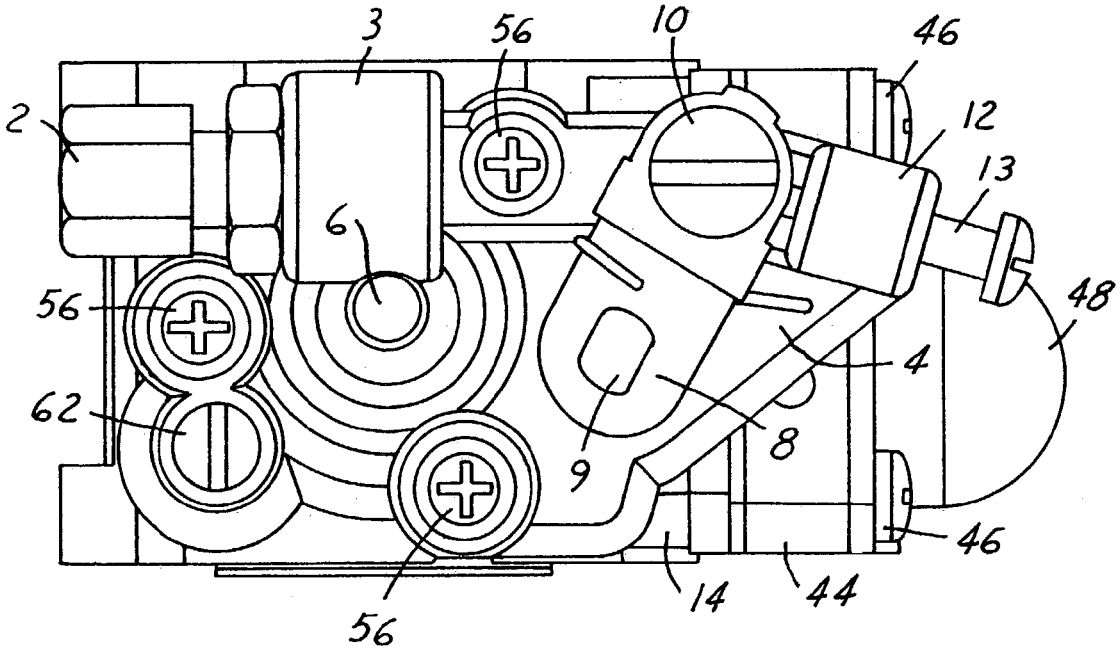
FIG. 3 is a plan view of the rotary throttle valve carburetor.
Figure 4:
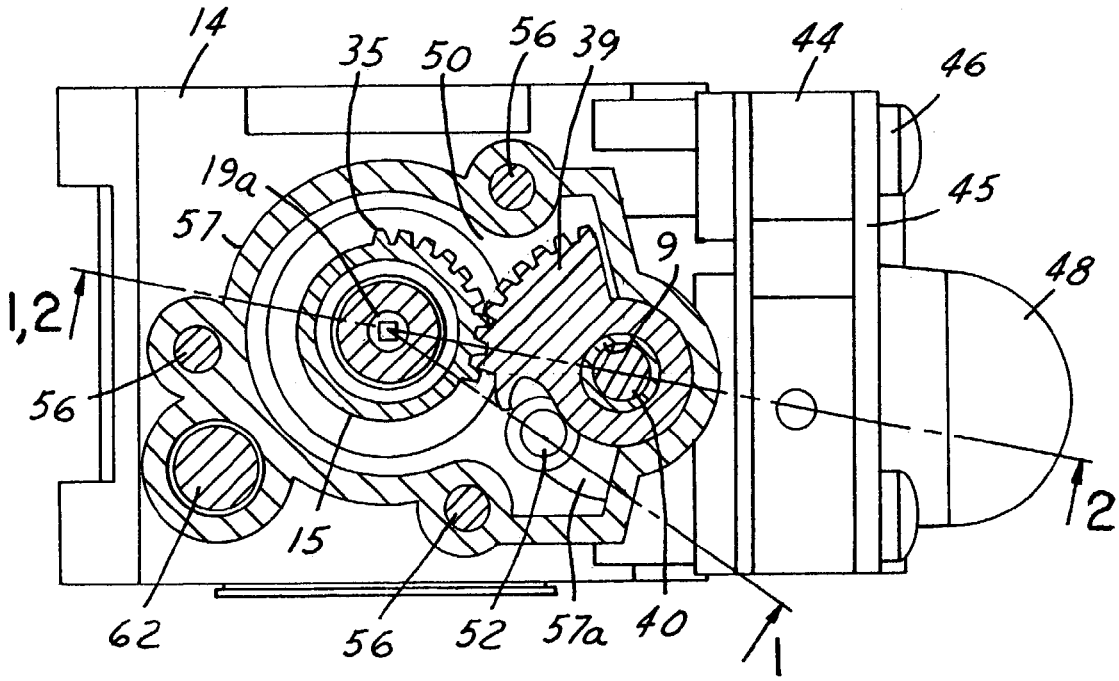
FIG. 4 is a plan sectional view taken generally along line 4—4 of FIG. 1 of the rotary throttle valve carburetor.

An encasing chamber 50 surrounded by a wall 57, shown in FIG. 4, is formed in the upper portion of the carburetor body 14. A driven gear (preferably a partial gear) 35 is formed on the rotary throttle valve 15. A lid plate 4 is put over the upper end of the carburetor body 14, and secured by a plurality of bolts 56 (FIG. 3). A return spring 16 is interposed between the lid plate 4 and the rotary throttle valve 15 with one end of the spring 16 disposed in an annular groove formed on the upper end of the rotary throttle valve 15, and secured to the rotary throttle valve 15. The other end of the spring 16 is disposed in an annular groove formed on the lid plate 4, and secured to the lid plate 4. The rotary throttle valve 15 is axially biased against the cam 22 and yieldably rotatably biased to its idle position by the force of the return spring 16.

One end of a fuel supply pipe 20 is secured to the carburetor body 14, and the other end of the fuel supply pipe 20 is projected into the throttle hole 18 of the rotary throttle valve 15. A threaded portion 19*a* (FIG. 5) is engaged in a threaded hole of the upper end portion of the rotary throttle valve 15, and a needle 19 connected to the threaded portion 19*a* is inserted into the fuel supply pipe 20 to adjust the effective opening or flow area of a fuel nozzle hole 20*a* (FIG. 5) of the fuel supply pipe 20.

As shown in FIG. 4, a drive gear (preferably a partial gear) 39 meshed with the driven gear 35 is connected to a hollow shaft 9. The hollow shaft 9 is rotatably engaged with a support shaft 40 secured to the carburetor body 14 in parallel to the rotary throttle valve 15. The hollow shaft 9 projects upward through an opening of the lid plate 4, and is connected to an operating lever 8. A spring 7 (FIGS. 1 and 2) is wound about the upper end of the hollow shaft 9 and the upper and lower ends thereof are secured to the operating lever 8 and the lid plate 4, respectively. The operating lever 8 is yieldably biased into contact with an end of an idle stop bolt 13 by the force of the spring 7. The idle stop bolt 13 is threaded in a wall 12 of the lid plate 4, an outer tube of a known remote control cable is connected to hollow mounting fittings 2 which are threadedly received on a projecting flange wall 3 of the lid plate 4, whereas an inner wire fitted in the outer tube is connected to a swivel 10 of the operating lever 8.

Figure 5:
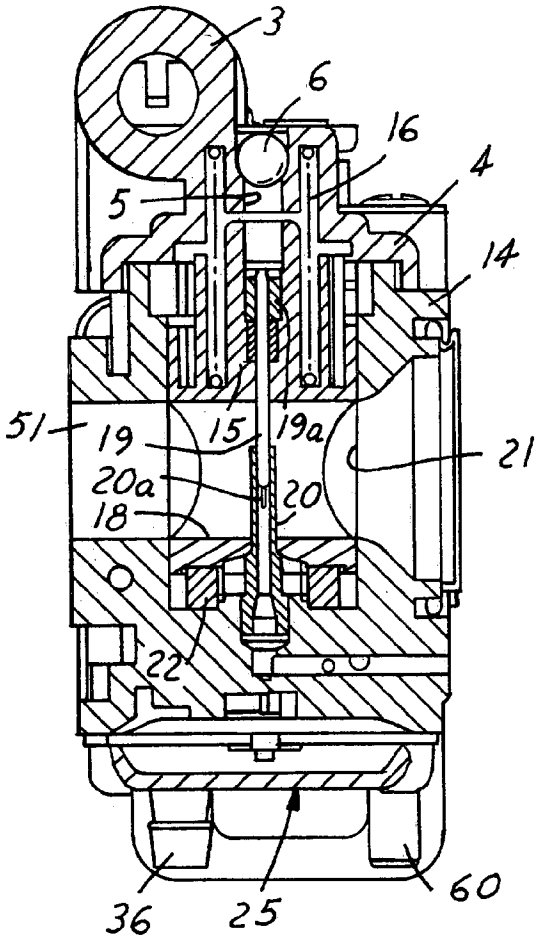
FIG. 5 is a side sectional view of the rotary throttle valve carburetor.

As shown in FIG. 5, the axial position of the needle 19 can be adjusted by a screw driver or the like inserted into a hole 5 provided in the lid plate 4 to adjust the extent to which the fuel nozzle hole 20*a* is open when the throttle valve 15 is in its idle position. A steel ball 6 is pressed into the regulating hole 5 to inhibit or prevent alteration of the idle setting.

As shown in FIGS. 1 and 2, a fuel pump 30 and a purge and priming pump 47 are provided on the carburetor body 14. A fuel pump diaphragm 32 is trapped between the body 14 and a plate 44. A pump chamber 31 is formed on one side of the diaphragm 32, and a pulsation pressure chamber 33 for introducing a pulsating pressure signal of a crank chamber of the engine is formed on the other side of the diaphragm 32. When the diaphragm 32 is vibrated or displaced, fuel in a fuel tank, not shown, is taken into the pump chamber 31 via an inlet pipe 36 and an intake valve (not shown), and is supplied to a fuel metering chamber 26 via a discharge valve (not shown) and an inlet valve (not shown) at a fuel inlet 23 of a constant pressure fuel supply mechanism 25.

A bulb 48 of the suction pump 47 is secured on the body 14 by a retaining plate 45 having an opening through which a portion of the bulb 48 projects. The retaining plate 45 is fastened to the carburetor body 14 by a plurality of bolts 46. A mushroom shape composite check valve 42 is connected to the plate 44 within a pump chamber 43 defined in part by the bulb 48. When the bulb 48 is repeatedly pressed prior to the start of the engine, fuel vapor in the fuel metering chamber 26 pushes open a bevel portion of the composite check valve 42 and flows into the pump chamber 43. Subsequent depression of the bulb 48 pushes open a flat central tube portion of the composite check valve 42 and returns the vapor, air and/or liquid fuel in the bulb 48 to the fuel tank via an outlet pipe 60 (FIG. 5).

The constant pressure fuel supply mechanism 25 has a cover plate 29 connected to the carburetor body 14 by bolts 24 with a fuel metering diaphragm 27 therebetween. The fuel metering chamber 26 and an atmospheric chamber 28 are defined on opposite sides of the diaphragm 27, respectively. Although not shown, a lever mechanism is disposed in the fuel metering chamber 26 and oscillates in response to the vertical movement of the diaphragm 27 and opens and closes an inlet valve (not shown) disposed on the fuel inlet 23. A fuel outlet 61 of the fuel metering chamber 26 is communicated with the fuel supply pipe 20 via a check valve (not shown) and a fuel adjustment needle valve 34.

Figure 8:
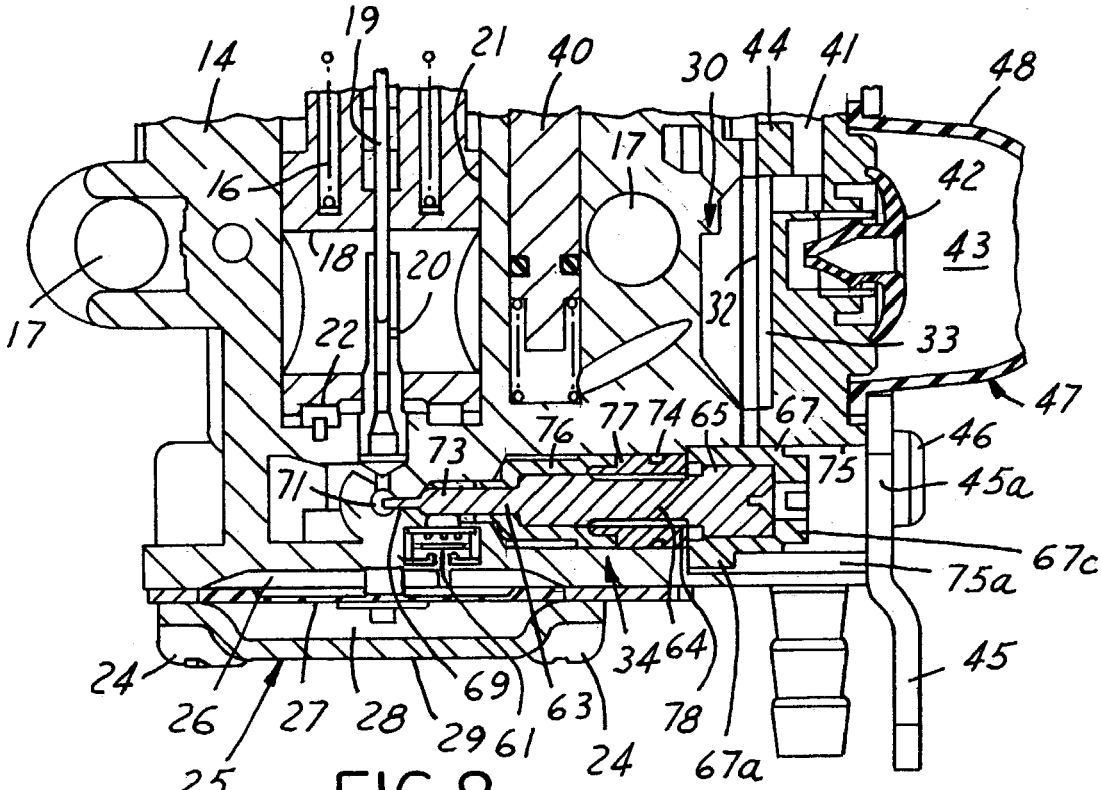
FIG. 8 is a partial front sectional view showing an antiturning body of a fuel adjustment needle valve splined in a head portion of an adjustment bolt.

As shown in FIGS. 2 and 4, an accelerating pump 54 is disposed between the valve chamber 21 and the support shaft 40. That is, a cam groove 39*a* of which depth becomes gradually shallower in a peripheral or circumferential direction is formed in the lower surface of the drive gear 39, and the upper end of a plunger 52 is engaged with the cam groove 39*a* by the force of a spring. The plunger 52 is received in a cylindrical bore 53 formed in the carburetor body 14. The lower end of the bore 53 is communicated with the fuel supply pipe 20 via a fuel passage 55. One end of the fuel passage 55 is closed by a ball plug 58. When the engine is accelerated, the cam groove 39*a* becomes increasingly shallower with the rotation of the drive gear 39, the plunger 52 is pushed down, and fuel in the bore 53 is supplied to the fuel supply pipe 20 providing additional fuel to support engine acceleration. The fuel metering chamber 26 is communicated with the outlet passage 61, a check valve, fuel adjustment needle valve 34, passage 71 and the fuel supply pipe 20, as shown in FIG. 8.

On the carburetor body 14 an air adjustment needle valve 62 is provided for adjusting the quantity of air in a bypass passage suitable for an increase of fuel when the engine starts in cold ambient weather. Further, FIGS. 1 and 2 are synthesized from a front view and a plan view by CAD, and the fuel adjustment needle valve 34 is different from the actual shape and is shown bent.

As described above, according to the present invention, since the driven gear 35 formed on the rotary throttle valve 15 and the drive gear 39 connected to the hollow shaft 9 are meshed with each other, and the gears 35 and 39 are disposed in the encasing chamber 50 closed by the lid plate 4, it is possible to completely prevent outside dust or the like from entering and fouling the valve chamber 21, and since the operating lever 8 for operating the rotary throttle valve 15 is connected to the hollow shaft 9, the total height of the carburetor can be reduced.

The idle position and the fully opened position of the rotary throttle valve 15 are controlled by the idle stop bolt 13 and the projecting wall 3 of the lid plate 4, respectively, against which the operating lever 8 impinges. The accelerating pump 54 driven by the cam groove 39*a* on the lower surface of the drive gear 39 is disposed in a raised portion of the extra thick wall between the valve chamber 21 and the hollow shaft 9 to thereby minimize the size of the carburetor.

The hole 5 is provided coaxial with the needle 19 on the lid plate 4. The threaded portion 19*a* of the needle 19 is turned by a screw driver or the like from within the hole 5 to adjust an opening degree of the fuel nozzle hole 20*a*, and thereafter, the steel ball 6 is pressed into the hole 5. Therefore, the valve chamber 21 is sealed from outside, and the seal force is received by the carburetor body 14. Thus, the above feature does not impart adverse influence such as deformation to the sliding part of the rotary throttle valve 15, and the steel ball 6 pressed into the regulating hole 5 prevents adjustment of the needle 19 setting to control the idle fuel and air mixture for improved exhaust gas control.

Since the cam body of the accelerating pump 54 is provided on the lower surface of the drive gear 39 disposed beneath the cover 4, and since the thickness of the cam body secures the length L (FIG. 1) of the shaft support part, the extent to which the shaft 9 extends outward from the cover 4 is minimal, and there is no uneven or axial force that tends to move the hollow shaft 9 downwardly as the operating lever 8 is turned. Thus, dust and other contaminants are not carried down underneath the cover 4 ensuring smooth rotary operation of the hollow shaft 9 and the lever 8.

Figure 9:
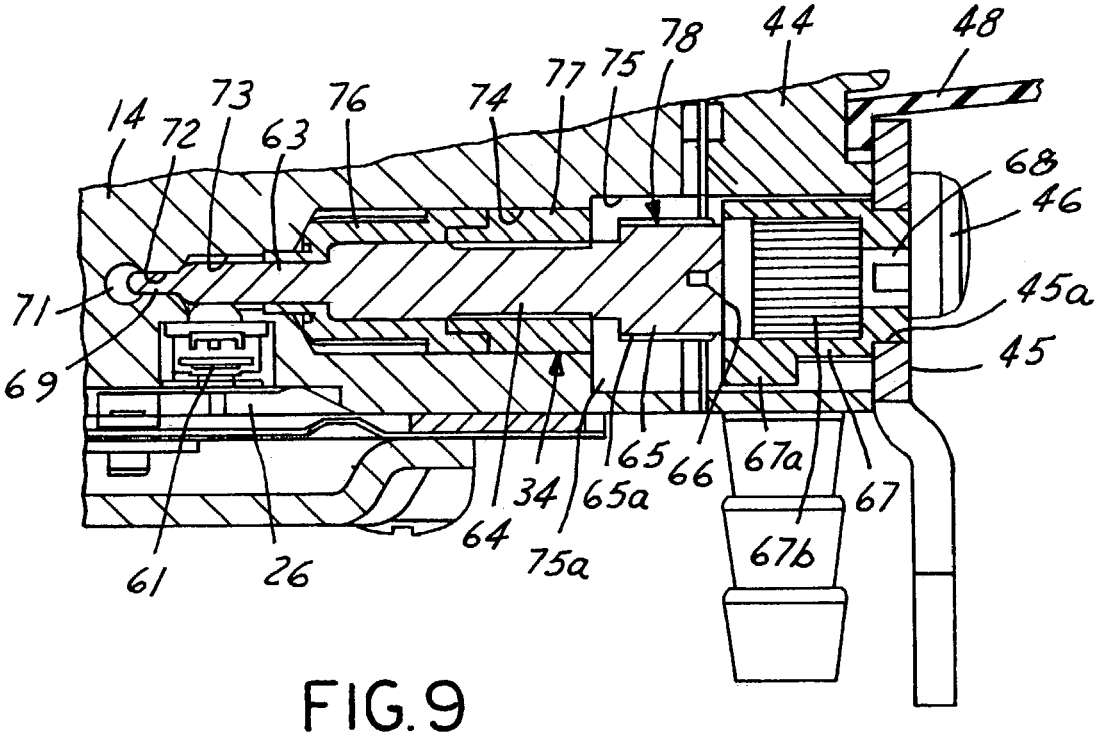
FIG. 9 is a front sectional view showing a fuel adjustment needle valve in which the antiturning body is held in a holding hole of a pump cover plate.

In the illustrated embodiment as shown in FIGS. 8 and 9, the fuel metering chamber 26 is communicated with the fuel supply pipe 20 via a check valve on the fuel outlet 61, a first counterbore 73 of a fuel adjustment needle valve 34, a gap between a passage or bore and needle 69, and a passage 71.

An antiturning body 67 for locking the fuel adjustment needle valve 34 to inhibit tampering or inadvertent adjustment of the needle valve 34 is disposed in a third counterbore 75 in the carburetor body 14, and covered with an extended portion of a retaining plate 45 having a hole 45*a*. The third counterbore 75 is larger in diameter than the hole 45*a*, a second counterbore 74, the first counterbore 73 and the passage or bore 72 which become smaller in inside diameter and are preferably coaxially aligned with the hole 45*a*. A soft resin sleeve 76 is fitted in the second counterbore 74, and a small diameter portion at one end of the resin sleeve 76 is fitted in the first counterbore 73. A metal sleeve 77 having a tapped hole is fitted in the second counterbore 74, and a small diameter portion at one end of the metal sleeve 77 is fitted in the resin sleeve 76. The adjustment bolt 78 is formed with a threaded shaft portion 64, a shaft portion 63 smaller in diameter than the inside diameter of the first counterbore 73 and a needle 69 which become narrower in order from the head 65 to the other end at the needle 69. When the threaded shaft portion 64 is threaded in the metal sleeve 77, the end portion of the resin sleeve 76 is placed in close contact with the first counterbore 73 by shaft portion 63, and the needle 69 is projected into the bore 72.

As shown in FIG. 9, after the adjustment bolt 78 has been incorporated in the carburetor, the small diameter end of the antiturning body 67 is fitted into the hole 45*a* of the retaining plate 45, and then the retaining plate 45 is fastened to the plate 44 by a plurality of bolts 46. The antiturning body 67 is provided with a tool engaging hole 68 and a spline hole 67*b* in engagement with a spline shaft portion 65*a* of the head 65. At the time of shipment from the factory, the antiturning body 67 is separate from the head portion 65. A tool such as a screw driver is engaged with a slot 66 of the adjustment bolt 78 through the tool receiving hole 68 of the antiturning body 67, the adjustment bolt 78 is advanced or retracted to adjust the flow rate of fuel that flows from the fuel metering chamber 26 to the passage 71 via the check valve on the fuel outlet 61, the first counterbore 73 and the passage or bore 72. Subsequently, the spline hole 67*b* of the antiturning body 67 is advanced or pushed to fit on the spline shaft portion 65*a* of the head portion 65 (as shown in FIG. 8) so that at least one and preferably, a plurality of ridges or flanges on one spline portion 67*b*, 65*a* are received in complementary grooves in the other spline portion 67*b*, 65*a*. An antiturning piece key or 67*a* projecting radially outwardly from the antiturning body 67 is always engaged with an axial groove 75*a* formed on the inner peripheral surface of the third counterbore 75. With the antiturning body fixed against rotation and coupled to the adjusmtent bolt 78, the adjustment bolt 78 cannot be rotated. Further, since the largest outside diameter of the antiturning body 67 is larger than the diameter of the hole 45*a*, the antiturning body 67 cannot be removed with the retaining plate 45 in place. Accordingly, the engine operator cannot rotate the adjustment bolt 78 of the fuel adjustment needle valve 34 arbitrarily to adjust quantity of fuel, nor can the needle valve 34 inadvertently rotate.

It is noted that the fuel adjustment needle valve 34 of the present invention is not limited to a diaphragm-type carburetor but can also be applied to a float bowl carburetor. Further, the fuel adjustment needle valve 34 of the invention is not limited to a rotary throttle valve system carburetor but can also be applied to a butterfly or slide-type throttle valve carburetor.

In the illustrated embodiment of FIGS. 10 to 15, a hollow shaft 9 is rotatably supported on a lid plate 4 in parallel with a rotary throttle valve, an upper end of the rotary throttle valve being covered with the lid plate 4. A swivel 10 is rotatably supported on the free end of an operating lever 8 connected to the hollow shaft 9, and the operating lever 8 can be turned between an idle position yieldably biased against the idle stop bolt 13 by force of a return spring, not shown, and a fully opened position placed in contact with a stop wall 96 of a cable holder 80. The idle stop bolt 13 is threaded in a projecting wall 12 at an edge of the lid plate 4. Although not shown, a drive gear connected to the hollow shaft 9 and a driven gear connected to the rotary throttle valve are meshed with each other, and the rotary throttle valve is rotated by the turning of the operating lever 8. The aforementioned constitution is disclosed in Japanese Patent Application No. 2002-161710.

Figure 11:
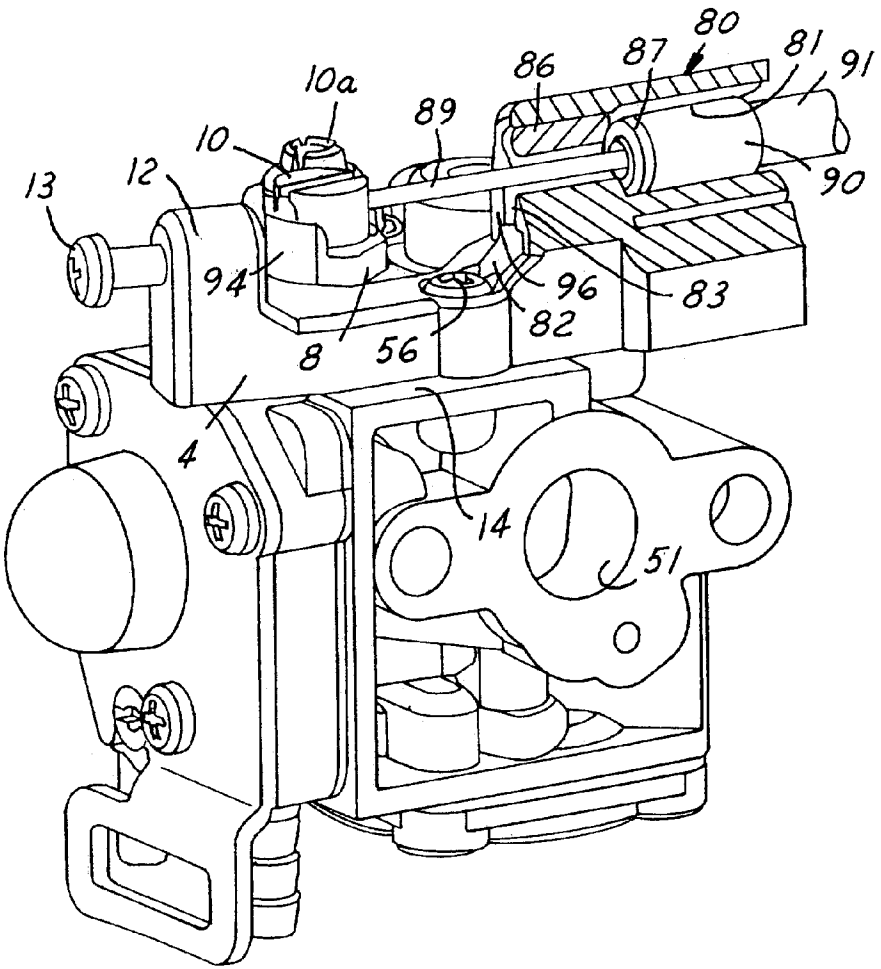
FIG. 11 is a perspective view of the carburetor of FIG. 10 with a portion in section showing the throttle valve operating mechanism.
Figure 10:
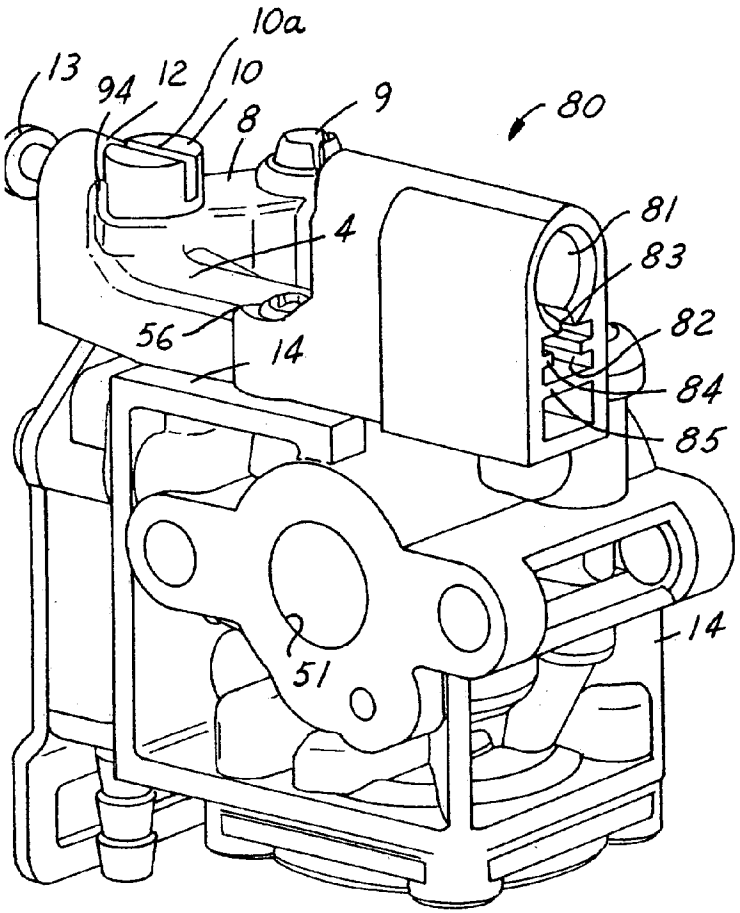
FIG. 10 is a perspective view of an alternate embodiment of a carburetor provided with a throttle valve operating mechanism.
Figure 12:
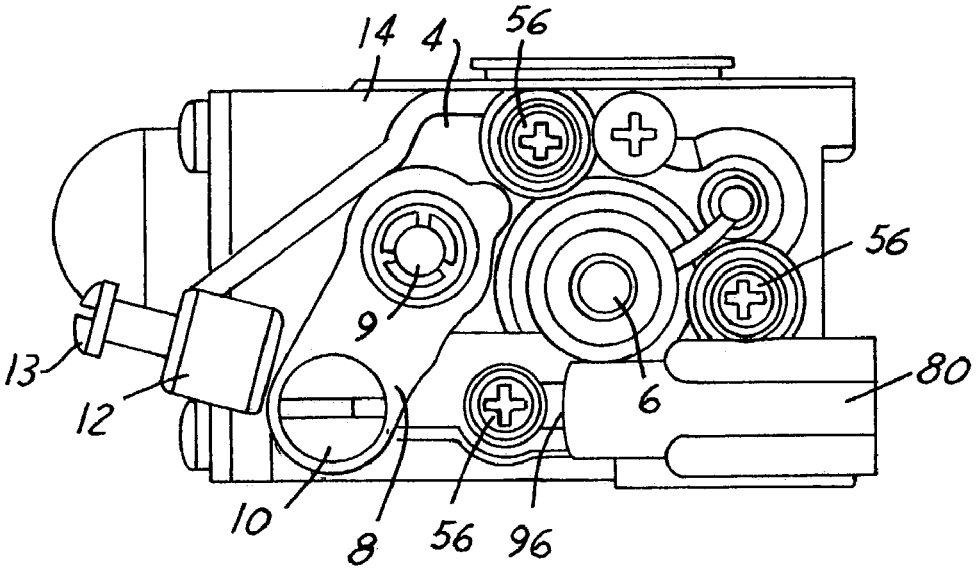
FIG. 12 is a plan view of the carburetor of FIG. 10 showing the throttle valve operating mechanism.
Figure 13:
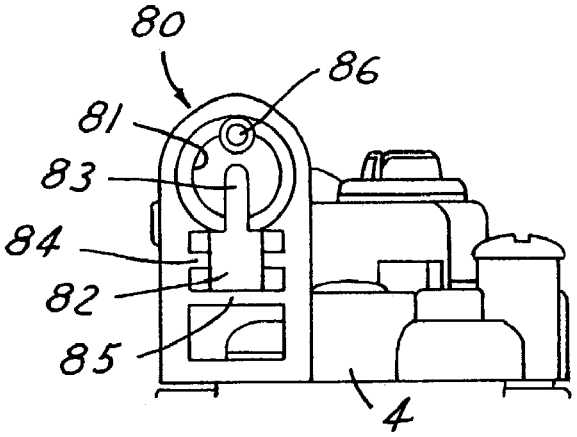
FIG. 13 is a side view of a lid plate provided with a cable holder of the throttle valve operating mechanism.
Figure 14:
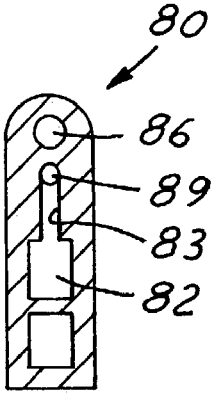
FIG. 14 is a side sectional view of a rear portion of the cable holder.

As shown in FIGS. 10 and 13, the cable holder 80 of the throttle valve operating mechanism is provided on the lid plate 4 opposite to the swivel 10. The cable holder 80 is preferably formed integral with the lid plate 4. A receiving cylinder 81 for fitting an end of an outer tube 91 covered with a metal cover 90 is formed on the right half portion of the cable holder 80, and a slit 83 is open to the receiving cylinder 81 and an insert port 82 preferably of rectangular shape in section. The insert port 82 is reinforced by a pair of reinforcing ribs 84, and communicated with the receiving cylinder 81 through the slit 83. As shown in FIG. 11, a self-tapping hole for an adjustment bolt 86 is provided on the upper side of the slit 83 in the cable holder 80. The adjustment bolt 86 projects toward the receiving cylinder 81 and comes in contact with the metal cover 90 or the end of the outer tube 91 through a thrust washer 87 so that an axial position of the end of the outer tube 91 with respect to the receiving cylinder 81 may be adjusted. The left end surface of the cable holder 80 constitutes a stop wall 96 of the rotary throttle valve that is engaged by the throttle valve lever 8 when the throttle valve 15 is in its wide open position.

Figure 15:
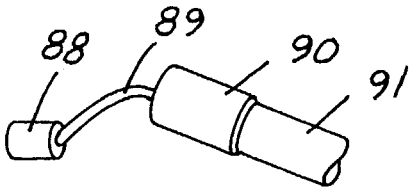
FIG. 15 is a fragmentary perspective view showing an end portion of an inner wire to be mounted on the cable holder.
Figure 16:
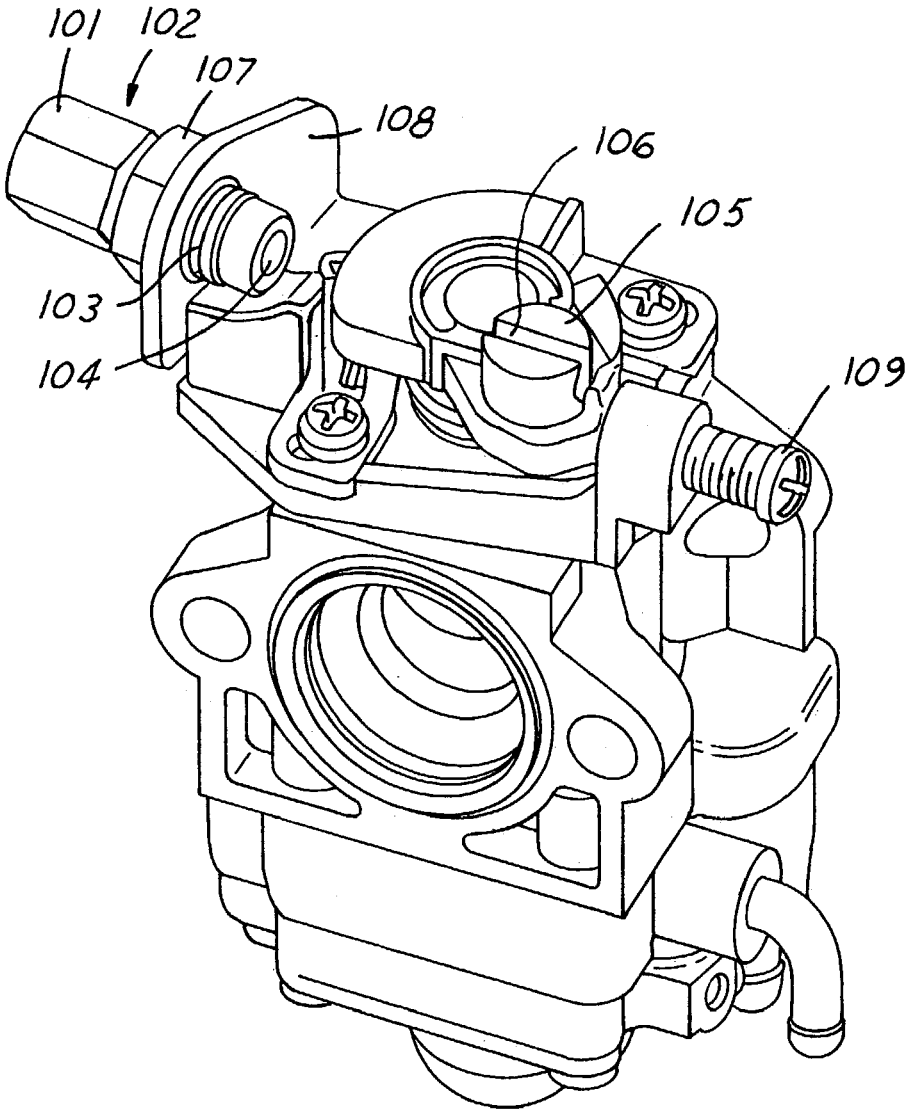
(PRIOR ART) FIG. 16
FIG. 16 is a perspective view of a carburetor according to the prior art.

When the remote control cable is mounted on the carburetor, the end of the inner wire 89 is inserted into the insert port 82, and the end of the outer tube 91 is fitted in the receiving cylinder 81. Since the inner wire 89 crosses the slit 83, while the end of the outer tube 91 is pushed into the receiving cylinder 81, the end of the outer tube 91 comes in contact with the adjustment bolt 86 through the thrust washer 87, and the inner wire 89 projects through the stop wall 96. Then, the end of the inner wire 89 is drawn out of the slit 83 and engaged on the split groove 10*a* of the swivel 10. As shown in FIG. 15, a retainer 88 larger in diameter than that of the inner wire 89 is connected to the end of the inner wire 89, and the retainer 88 is fitted in a cylindrical portion adjacent to the split groove 10*a* of the swivel 10.

As shown in FIG. 11, even if the inner wire 89 is loosened, the inner wire 89 is prevented from dropping out from the swivel 10 by a flange 94 upwardly projected from the operating lever 8. Since the end of the inner wire 89 is retained in the slit 83, the outer tube 91 is not disengaged from the receiving cylinder 81 and the end of the inner wire 89 may be stopped at the split groove 10*a* of the swivel 10. After the end of the inner wire 89 has been mounted in the split groove 10*a* of the swivel 10, any "play" in the inner wire 89 is adjusted by the adjustment bolt 86 so that the rotary throttle valve may be returned to the idle position by force of a return spring, not shown.

The throttle valve operating mechanism of the present invention is not limited to the aforementioned embodiment, but can be also applied to, for example without limitation, other rotary throttle valve-type carburetors or slide or butterfly throttle valve-type carburetors.

In the carburetor as shown and described, since the rotary throttle valve is rotatably fitted in the valve chamber on the carburetor body and the annular cam is arranged against the end of the rotary throttle valve on the carburetor body, the cam can be molded, for example, of resin or the like and is easy to produce. While there is provided a pin for preventing turning of an annular cam in order to hold the annular cam on the carburetor body, it is noted that the annular cam may be pressed in and secured to the bottom of the valve chamber or may be held merely by the force of a return spring that yieldably biases the throttle valve toward its idle position. The rotary throttle valve and the annular cam are in linear or axial contact, and there is no inclination of the rotary throttle valve, providing excellent durability.

Since the drive gear meshed with the driven gear formed on the rotary throttle valve is rotatably supported on the support shaft secured to the carburetor body, and the hollow shaft projecting from the lid plate is operated by the operating lever, all the turning operating forces are received by the support shaft. The force for axially displacing the rotary throttle valve is not exerted on the throttle valve lever and the opening and closing of the throttle valve can be done smoothly. Since the driven gear and the drive gear are disposed in the encasing chamber which is sealed by the lid plate, no dust moves into the encasing chamber and the wear resistance and the durability of the gears and the rotary throttle valve are improved. Since the drive gear having a cam surface of the accelerating pump is connected to the end of the hollow shaft, the length of the support portion of the support shaft can be secured on the side of the carburetor body and the outwardly projecting height of the hollow shaft can be minimized.

The gear ratio between the driven gear and the drive gear is preferably made large and the displacement amount of the driven gear with respect to the operating amount (angle) of the drive gear is preferably made large, the amount of displacement of the swivel of the operating lever for transmitting the external operating force becomes small, and the change in angle in a pulling direction of the inner wire becomes small.

Since the cam surface in contact with the end of the accelerating pump is formed on the lower surface of the drive gear and the accelerating pump is disposed between the valve chamber and the support shaft, a dead space of the carburetor body can be used for the arrangement of the accelerating pump, thus contributing to the minimization of the carburetor size.

What is claimed is:

1. A carburetor, including:

a body having an air intake passage formed therein and a throttle valve bore in communication with the air intake passage;

a cam formed separately from the body and received in the body at one end of the throttle valve bore the cam having a cam surface with a varying height and inclined to an axis of the bore;

a throttle valve being rotatably carried by the body for rotation relative to the throttle valve bore and the air intake passage, disposed at least in part in the throttle valve bore and having opposed ends and with one end carrying a follower received against the cam surface for generally axially moving the throttle valve in response to rotation of the throttle valve; and a throttle valve lever operably connected to the throttle valve adjacent to an end of the throttle valve spaced from the cam to cause rotation of the throttle valve when the throttle valve lever is moved.

2. A carburetor, including:

a body having an air intake passage formed therein and a throttle valve bore in communication with the air intake passage;

a cam at one end of the throttle valve bore;

a throttle valve being rotatably carried by the body for rotation relative to the throttle valve bore and the air intake passage, disposed at least in part in the throttle valve bore and having opposed ends and with one end received against the cam;

a throttle valve lever operably connected to the throttle valve adjacent to an end of the throttle valve spaced from the cam to cause rotation of the throttle valve when the throttle valve lever is moved; and wherein the cam is annular and is formed separately from the carburetor body.

3. The carburetor of claim 2 wherein the cam has at least one pin for receipt in a complementary hole in the carburetor body to locate the cam relative to the carburetor body.

4. The carburetor of claim 2 wherein the cam has a pair of cam surfaces formed to cause axial displacement of the throttle valve as the throttle valve is rotated relative to the cam, and the throttle valve includes a pair of followers with each follower engaging a separate one of the cam surfaces.

5. The carburetor of claim 2 which also includes a biasing member yieldably biasing the throttle valve against the cam so that when it is rotated the throttle valve is responsive to the shape of the cam.

6. The carburetor of claim 5 wherein the biasing member includes a spring, and the spring also yieldably rotatably biases the throttle valve to an idle position of the throttle valve.

7. A carburetor, including:

a body having an air intake passage formed therein and a throttle valve bore in communication with the air intake passage;

a cam at one end of the throttle valve bore;

a throttle valve being rotatably carried by the body for rotation relative to the throttle valve bore and the air intake passage, disposed at least in part in the throttle valve bore and having opposed ends and with one end received against the cam;

a throttle valve lever operably connected to the throttle valve adjacent to an end of the throttle valve spaced from the cam to cause rotation of the throttle valve when the throttle valve lever is moved; and a driven gear associated with the throttle valve for co-rotation of the driven gear and throttle valve, a shaft carrying the throttle valve lever, and a drive gear carried by the shaft for co-rotation with the throttle valve lever in accordance with movement of the throttle valve lever, the drive gear being meshed with the driven gear so that movement of the throttle valve lever causes a corresponding rotation of the throttle valve.

8. The carburetor of claim 7 which also includes a lid plate carried by the body with the throttle valve, drive gear and driven gear disposed between the body and the lid plate.

9. The carburetor of claim 8 wherein the shaft that carries the throttle valve lever projects through the lid plate and the throttle valve lever is disposed on the opposite side of the lid plate from the drive gear.

10. The carburetor of claim 7 which also comprises an accelerating pump cam disposed adjacent to the drive gear and a plunger in contact with the accelerating pump cam and carried by the body within a bore formed in the body, the bore within the body being in communication with a supply of fuel and with the air intake passage so that when the plunger is displaced in one direction within the bore, fuel in the bore is discharged for delivery to the air intake passage.

11. The carburetor of claim 7 wherein the shaft that carries the throttle valve lever includes a stop surface adapted to engage an obstruction carried by the body when the throttle valve is in its idle position.

12. The carburetor of claim 7 wherein the shaft that carries the throttle valve lever includes a second stop surface adapted to engage an obstruction carried by the body when the throttle valve is in its wide open position.

13. The carburetor of claim 11 wherein the obstruction carried by the body is an idle stop screw that is adjustably carried by the body to permit adjustment of the idle position of the throttle valve.

14. The carburetor of claim 12 wherein the obstruction carried by the body is a wall projecting from the body.

15. The carburetor of claim 12 which also comprises:

a fuel adjustment needle valve having a threaded shank portion adapted to be rotatably received in a complementary threaded bore in the carburetor body to permit the fuel adjustment needle valve to be advanced and retracted relative to the carburetor body, a head engageable by a tool to permit rotation of the fuel adjustment needle valve, and a spline portion; and a retaining body constructed to be selectively received over the head of the fuel adjustment needle valve and having a spline portion capable of being mated with the spline portion of the fuel adjustment needle valve, a key adapted to be selectively received in a groove in a carburetor body to prevent rotation of the retaining body relative to the carburetor body, and a hole formed in the retaining body permitting access to the head of the fuel adjustment needle valve so that a tool may be inserted through the hole to adjust the position of the fuel adjustment needle valve, and thereafter the retaining body can be disposed over at least a portion of the head of the fuel adjustment needle valve so that the spline portion of the retaining body mates with the spline portion of the fuel adjustment needle valve to prevent relative rotation between the retaining body and the fuel adjustment needle valve and when in this position the key is received within a groove in the carburetor body preventing rotation of the retaining body relative to the carburetor body to thereby prevent rotation of the fuel adjustment needle valve relative to the carburetor body.

16. The carburetor of claim 15 wherein the spline portion of the fuel adjustment needle valve includes at least one flange formed about an exterior of the head, and the spline portion of the retaining body includes at least one groove capable of receiving a flange.

17. The carburetor of claim 15 wherein the spline portion of the fuel adjustment needle valve includes a plurality of flanges, and the spline portion of the retaining body includes a plurality of grooves.

18. A carburetor, including:

a body having an air intake passage formed therein and a throttle valve bore in communication with the air intake passage;

a cam at one end of the throttle valve bore;

a throttle valve being rotatably carried by the body for rotation relative to the throttle valve bore and the air intake passage, disposed at least in part in the throttle valve bore and having opposed ends and with one end received against the cam;

a throttle valve lever operably connected to the throttle valve adjacent to an end of the throttle valve spaced from the cam to cause rotation of the throttle valve when the throttle valve lever is moved; and a cable holder including a receiving cylinder for receiving an end of an outer tube of a remote control throttle cable, an insert port generally adjacent to the receiving cylinder, and a slit communicating the receiving cylinder with the insert port so that an inner wire of the remote control throttle cable may be received in the insert port and extended through the cable holder for attachment to the throttle valve lever.

19. The carburetor of claim 18 which also includes an adjustment bolt threadedly received by the cable holder for abutment with the end of the outer tube to limit insertion of the outer tube relative to the cable holder.

20. The carburetor of claim 18 wherein at least one reinforcing rib is provided on the port.

21. The carburetor of claim 18 which also comprises a lid plate disposed over the throttle valve and carried by the body and wherein said cable holder is integrally formed with the lid plate of the carburetor.

22. The carburetor of claim 18 wherein the throttle valve lever engages the cable holder in one direction of rotation of the throttle valve lever to limit movement of the throttle valve lever in that direction.

* * * * *

UNITED STATES PATENT AND TRADEMARK OFFICE

CERTIFICATE OF CORRECTION

PATENT NO. : 7,007,931 B2
APPLICATION NO. : 10/445510
DATED : March 7, 2006
INVENTOR(S) : Teruhiko Tobinai It is certified that error appears in the above-identified patent and that said Letters Patent is hereby corrected as shown below:

Column 9
Line 2, after "bore" insert a comma (,).

Signed and Sealed this

Twenty-first Day of November, 2006

JON W. DUDAS
*Director of the United States Patent and Trademark Office*